United States Patent [19]

Goss et al.

[11] 4,213,034

[45] Jul. 15, 1980

[54] CONDUCTION HEATING ASSEMBLY

[75] Inventors: David C. Goss; Richard A. Hageman, both of San Marcos, Tex.

[73] Assignee: Thermon Manufacturing Company, San Marcos, Tex.

[21] Appl. No.: 921,265

[22] Filed: Jul. 3, 1978

[51] Int. Cl.[2] ..... H05B 3/58

[52] U.S. Cl. ..... 219/535; 219/201; 219/523; 219/530; 219/540

[58] Field of Search ..... 219/201, 213, 462, 521, 219/523, 522, 524, 525, 530, 535, 536, 540

[56] References Cited

U.S. PATENT DOCUMENTS

| | | | |
|---|---|---|---|
| 1,092,790 | 4/1914 | Garrison et al. | 219/524 |
| 1,805,040 | 5/1931 | Groves | 219/535 X |
| 2,500,399 | 3/1950 | Broome | 219/535 |
| 2,910,567 | 10/1959 | Holstein | 219/535 X |
| 3,045,098 | 7/1962 | Norton | 219/535 |
| 3,047,704 | 7/1962 | Van Noy et al. | 219/524 X |
| 3,146,977 | 9/1964 | Coates et al. | 219/201 X |
| 3,335,459 | 8/1967 | Tyrner | 219/201 |
| 3,349,722 | 10/1967 | Davis | 219/213 X |
| 3,412,231 | 11/1968 | McElligott | 219/201 |
| 3,453,417 | 7/1969 | Hummel | 219/536 |

*Primary Examiner*—Volodymyr Y. Mayewsky
*Attorney, Agent, or Firm*—Pravel, Gambrell, Hewitt, Kirk, Kimball & Dodge

[57] ABSTRACT

A heating assembly adapted to be releasably mounted externally of an instrument for the transfer of heat to the instrument by conduction to maintain the instrument at a desired temperature.

3 Claims, 4 Drawing Figures

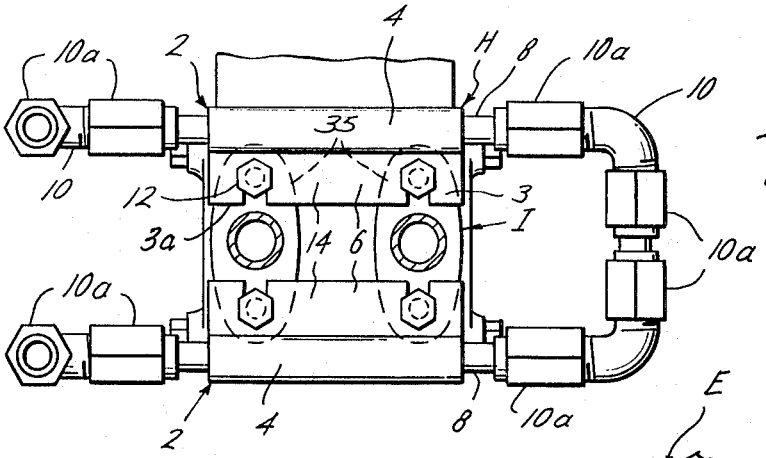
Fig. 1
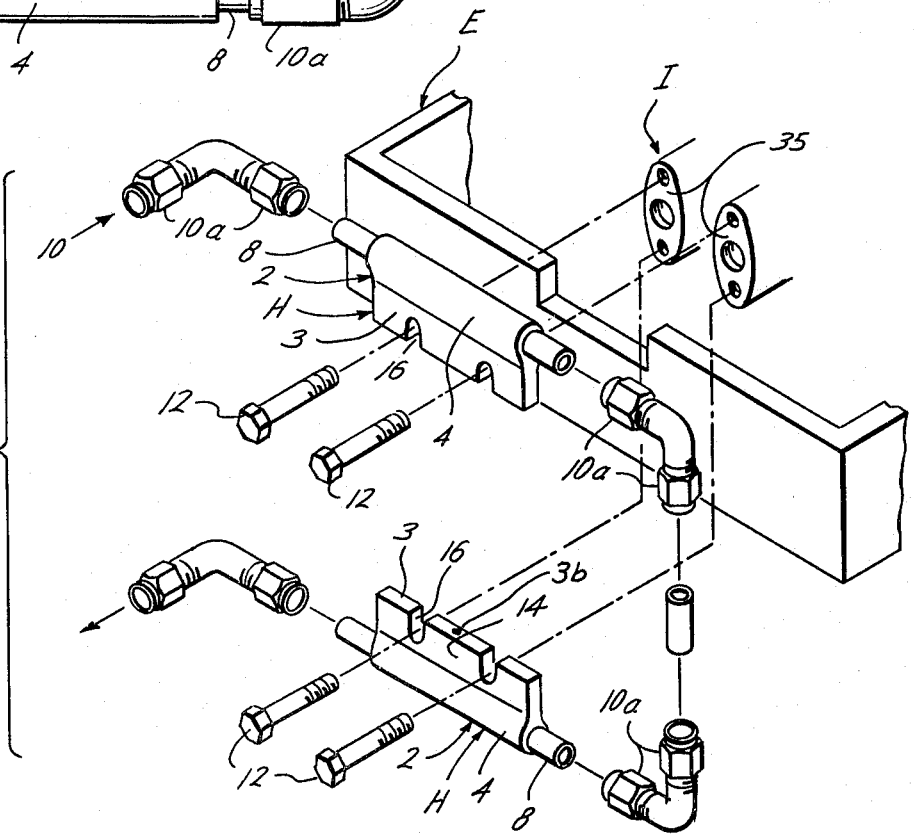
Fig. 2
Fig. 3
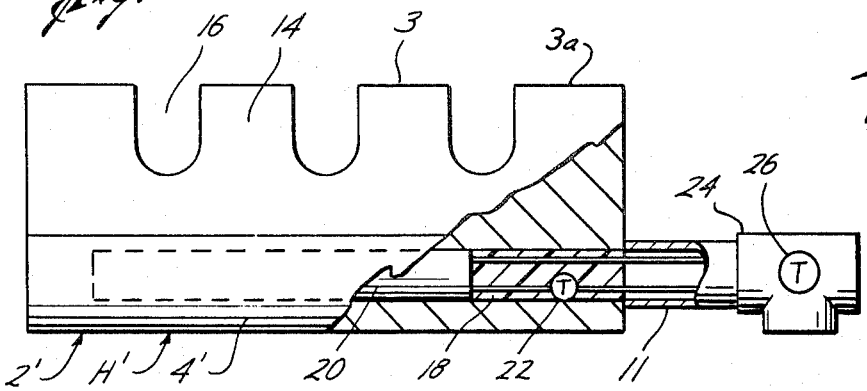
Fig. 4
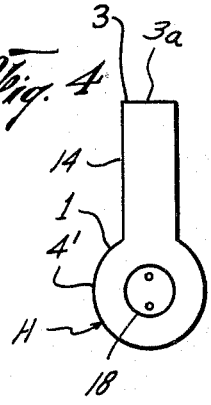

CONDUCTION HEATING ASSEMBLY

BACKGROUND OF THE INVENTION

The field of this invention is heating assemblies for transferring heat to instruments.

The use of thermostatically controlled electric resistance-type heaters is known in the art for accomplishing various heating objectives such as those disclosed in U.S. Pat. Nos. 1,627,564; 1,797,712; 2,606,271; 2,813,961; 2,906,849; 3,036,190; 3,146,977; 3,335,459; 3,349,722; and 3,412,231.

More specifically, the patent of E. L. Volling, U.S. Pat. No. 3,538,302, discloses threaded heat assemblies which are positioned in bolt openings of an instrument housing to thermostatically control the temperature of the instrument. Since the heating assemblies replace bolts in bolt openings of the instrument housing, the integrity of the instrument is disturbed and users are frequently concerned that such usage will cause damage to or malfunctioning of the instrument. Such arrangement further results in the disadvantage of producing localized heat within the instrument housing. In some instances, with the Volling device, because the localized heat generation is in proximity to sensitive portions of the instrument, an output signal is produced that is not representative of the actual conditions detected by the instrument.

SUMMARY OF THE INVENTION

The present invention provides a new and improved conduction heating assembly for use with instruments. The heating assembly is adapted to be mounted to the exterior of the instrument, the assembly preferably having a generally planar heat transfer surface for the conduction of evenly distributed heat thereto. The heating assembly assures substantially uniform distribution of the heat to the entire instrument body to thereby reduce or obviate inaccurate responses in the instrument which would otherwise be caused by localized heating in proximity to sensitive portions of the instrument.

BRIEF DESCRIPTION OF THE DRAWINGS

FIG. 1 is an elevation of the preferred form of this invention;

FIG. 2 is an exploded view in perspective of the two heating assemblies of FIG. 1 for mounting on an instrument in an enclosure;

FIG. 3 is a front view, partly in section, of a modified heating assembly with an electrical heating device; and FIG. 4 is an end view of the heating assembly of FIG. 3.

DESCRIPTION OF THE PREFERRED EMBODIMENT

In the drawings, the letter H designates the heating assembly of this invention, in two embodiments, in FIGS. 1–4. The letter I refers to the instrument with which heating assembly H is adapted to be used. The letter E refers to the insulated enclosure in which both the instrument I and heating assembly H are to be mounted for the maintenance of specified temperature parameters.

The heating assembly H of the preferred embodiment includes a heat transfer element 2, generally having an end shape as best seen in FIG. 4. It is understood, however, that the heating assembly of this invention is not limited to this physical configuration. As viewed from the end, the substantially circular portion 1 of the heat transfer element 2 is the heating means 4 and the substantially rectangular portion 3 is the heat transfer means.

As seen in FIGS. 1 and 2, the heating means 4 has a tubular means 8 connected to a tubular assembly 10 having suitable threaded or other types of couplings 10*a* therewith for the flow of temperature controlled fluid therethrough. The heat transfer means 3 has a first surface 3*a* and a flat or generally planar heat transfer surface 14 substantially perpendicular and adjacent thereto for transferring thermal energy from heating means 4 to the instrument I by conduction. The first surface 3*a* has a midpoint 3*b*. The heat transfer means 3 substantially conforms to the exterior of instrument I, and, further, serves to evenly distribute heat across heat transfer surface 14, avoiding localized heating.

Heat transfer element 2 is attached to instrument I, such as a differential pressure transmitter, by any suitable mounting means such as bolts 12. The heat transfer surface 14 of the heat transfer means 3 preferably has U-shaped slots 16 which serve as receiving means for receiving the bolts 12 or other mounting means.

In the operation or use of the heating assembly H, each element 2 is removably attached to a flat or generally planar surface 35 of the instrument I (FIGS. 1 and 2) in contact with the corresponding flat or generally planar surface 14 of each element 2, whereby heat, by conduction, is transferred from the heating means 4. The attachment is effected by the bolts 12, as explained.

The heating means 4 is supplied with hot fluid such as steam supplied to the tubular assembly and thus to the tubular passage 8 in each heating element 2. Normally, the heating fluid flows through the two elements 2 of the heating assembly H.

A second embodiment of heating assembly H′ is shown in FIGS. 3 and 4, wherein the parts which are the same as the assembly H of FIGS. 1 and 2 have same numerals, and with prime marks to indicate modified parts in some cases. The assembly H′ differs from the assembly H in that it has a hollow portion or recess 18 extending longitudinally through the previously described circular cross sectional portion 1. Recess 18 is adapted to receive an electrical heating element 20. For safety, electrical heating element 20 may include therewith a temperature limiting device 22, such as a thermostat, that will serve to interrupt the electrical circuit if the temperature of heating element 20 becomes dangerously high, possibly threatening damage to instrument I. Heating assemby H′ may be adapted to be used in combination with any suitable temperature control device 26 to maintain a specified operating temperature.

Such temperature control is used, for example, when the instrument I is a differential pressure transmitter employed in measurements relating to fluids whose viscosity is critically affected by temperature.

The operation of the heating assembly H′ of FIGS. 3 and 4 is the same as for the assembly H, except that the heating is by the electrical heating element 20 of the heating means 4′ instead of by heating fluid as in the assembly H. The heat transfer means 3 has a first surface 3*a* with a midpoint 3*b* and a heat transfer surface 14 substantially perpendicular and adjacent therto. The mounting of the element 2′ is preferably by the bolts 12, with the generally planar surface contact between surface 14 and the instrument surface 35 for the transfer of heat by conduction as described in connection with heating assembly H. It will be appreciated that the heating assembly H' preferably includes two heating elements 2', although single elements 2 and 2' may be used in some cases.

Either heating assembly H or H' and the instrument I may be mounted in the interior of an insulated enclosure E (a portion of which is shown in FIG. 2) to maintain the instrument I at a desired temperature within specified limits.

The foregoing disclosure and description of the invention are illustrative and explanatory thereof, and various changes in the size, shape and materials as well as the details of the illustrated construction may be made without departing from the spirit of the invention.

What is claimed is:

1. A heating assembly for use in heating an instrument, comprising:

a heating element adapted to be mounted to the exterior of the instrument to be heated, said heating element including a heat transfer means and a heating means;

said heat transfer means having a first surface and a heat transfer surface substantially perpendicular and adjacent to said first surface;

said heat transfer surface for engaging an external surface of the instrument;

said heat transfer means having an opening formed therethrough extending substantially perpendicularly through said heat transfer surface, said opening also formed adjacent said first surface to receive a mounting means therethrough;

said mounting means extending through said heat transfer surface, said mounting means substantially perpendicular to said heat transfer surface for securing said heating element to the instrument;

said heating means formed with said heat transfer means, said heating means having a hollow longitudinal portion with the axis thereof substantially parallel to said first surface at the midpoint thereof and substantially parallel to the plane of said heat transfer surface for receiving an electrical heating element;

said opening disposed between said first surface and said heating means; and said electrical heating element to provide heat to the heating means.

2. The structure set forth in claim 1, wherein: said mounting means is a bolt.

3. The structure set forth in claim 1, wherein: said openings are U-shaped slots.

* * * * *